US012458190B2

(12) United States Patent
Camplani et al.

(10) Patent No.: US 12,458,190 B2
(45) Date of Patent: Nov. 4, 2025

(54) VACUUM CLEANER

(71) Applicant: Dyson Technology Limited, Wiltshire (GB)

(72) Inventors: Massimo Camplani, Bristol (GB); Andrew Collingwood Watson, Gloucester (GB); David Alan Millington, Swindon (GB); Nathan Lawson Mclean, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 288 days.

(21) Appl. No.: 18/014,485

(22) PCT Filed: Jun. 3, 2021

(86) PCT No.: PCT/GB2021/051369
§ 371 (c)(1),
(2) Date: Jan. 5, 2023

(87) PCT Pub. No.: WO2022/008865
PCT Pub. Date: Jan. 13, 2022

(65) Prior Publication Data

US 2023/0255423 A1 Aug. 17, 2023

(30) Foreign Application Priority Data

Jul. 10, 2020 (GB) ..... 2010655

(51) Int. Cl.
*A47L 9/28* (2006.01)
*A47L 9/04* (2006.01)

(52) U.S. Cl.
CPC ..... *A47L 9/2826* (2013.01); *A47L 9/0405* (2013.01); *A47L 9/2842* (2013.01)

(58) Field of Classification Search
CPC .... A47L 9/2826; A47L 9/2831; A47L 9/2821; A47L 9/2805; A47L 9/2842; A47L 9/0405
See application file for complete search history.

(56) References Cited

U.S. PATENT DOCUMENTS 5,722,109 A 3/1998 Delmas et al.
9,717,387 B1 * 8/2017 Szatmary ..... G06N 3/008
(Continued)

FOREIGN PATENT DOCUMENTS

CN 106175599 A 12/2016
CN 108670119 A 10/2018
(Continued)

OTHER PUBLICATIONS

WO 2018/202367 A1 (machine translation) (Year: 2018).*
(Continued)

*Primary Examiner* — Andrew A Horton
(74) *Attorney, Agent, or Firm* — Tucker Ellis LLP

(57) ABSTRACT

A vacuum cleaner includes: a vacuum motor; a first sensor configured to generate first sensor signals based on sensed motion and orientation of the vacuum cleaner; a cleaner head comprising an agitator; one or more diagnostic sensors configured to generate second sensor signals based on sensed parameters of the cleaner head; and a controller configured to: process the generated first and second sensor signals to determine a type of surface on which the vacuum cleaner is being operated; and control the power of the vacuum motor in dependence on the determined type of surface.

11 Claims, 13 Drawing Sheets

(56) References Cited

U.S. PATENT DOCUMENTS

| | | | |
|---|---|---|---|
| 2002/0083548 | A1 | 7/2002 | Hansen |
| 2002/0112315 | A1 | 8/2002 | Conrad |
| 2005/0166354 | A1 | 8/2005 | Naoya |
| 2009/0271944 | A1 | 11/2009 | Lovelass |
| 2011/0232687 | A1 | 9/2011 | Stein |
| 2015/0264121 | A1 | 9/2015 | Van Biljon et al. |
| 2015/0265121 | A1 | 9/2015 | Kim et al. |
| 2016/0073844 | A1 | 3/2016 | Park |
| 2016/0235270 | A1 | 8/2016 | Santini |
| 2018/0000304 | A1 | 1/2018 | Zhong et al. |
| 2018/0008112 | A1 | 1/2018 | Ham et al. |
| 2018/0020893 | A1* | 1/2018 | Lee ..... A47L 9/2826 701/28 |
| 2019/0216282 | A1 | 7/2019 | Pohlman et al. |
| 2019/0387943 | A1 | 12/2019 | Kim |
| 2021/0393097 | A1 | 12/2021 | King et al. |
| 2023/0248197 | A1 | 8/2023 | Camplani et al. |
| 2023/0248198 | A1 | 8/2023 | Camplani et al. |
| 2023/0255421 | A1 | 8/2023 | Camplani et al. |
| 2023/0255422 | A1 | 8/2023 | Camplani et al. |
| 2023/0255425 | A1 | 8/2023 | Camplani et al. |
| 2023/0263347 | A1 | 8/2023 | Camplani et al. |
| 2023/0263354 | A1 | 8/2023 | Camplani et al. |
| 2023/0263355 | A1 | 8/2023 | Camplani et al. |

FOREIGN PATENT DOCUMENTS

| | | | |
|---|---|---|---|
| DE | 102014113796 | A1 | 3/2016 |
| DE | 102015108464 | A1 | 12/2016 |
| DE | 102018200691 | A1 | 7/2019 |
| EP | 2682034 | A2 | 1/2014 |
| EP | 3058860 | A1 | 8/2016 |
| EP | 3162266 | A1 | 5/2017 |
| EP | 3263004 | A1 | 1/2018 |
| EP | 3278698 | A1 | 2/2018 |
| GB | 2490256 | A | 10/2012 |
| GB | 2578872 | A | 6/2020 |
| JP | H04-250128 | A | 9/1992 |
| JP | H05-130960 | A | 5/1993 |
| JP | 05-269063 | A | 10/1993 |
| JP | H05-253152 | A | 10/1993 |
| JP | H06-154139 | A | 6/1994 |
| JP | 2009-172235 | A | 8/2009 |
| JP | 2010-115360 | A | 5/2010 |
| JP | 2011-188963 | A | 9/2011 |
| JP | 2012-101060 | A | 5/2012 |
| JP | 2012-148011 | A | 8/2012 |
| JP | 2013-198702 | A | 10/2013 |
| JP | 2013-202094 | A | 10/2013 |
| JP | 2015-521945 | A | 8/2015 |
| JP | 2015-156900 | A | 9/2015 |
| JP | 2015-165835 | A | 9/2015 |
| JP | 2016-022378 | A | 2/2016 |
| JP | 2017-080410 | A | 5/2017 |
| JP | 2018-101444 | A | 6/2018 |
| JP | 2019-111321 | A | 7/2019 |
| WO | 2012/077621 | A1 | 6/2012 |
| WO | 2018/202367 | A1 | 11/2018 |
| WO | 2020/106420 | A1 | 5/2020 |

OTHER PUBLICATIONS

International Search Report and Written Opinion received for PCT Patent Application No. PCT/GB2021/051373, mailed on Sep. 10, 2021, 12 pages.

International Search Report and Written Opinion received for PCT Patent Application No. PCT/GB2021/051369, mailed on Aug. 31, 2021, 12 pages.

International Search Report and Written Opinion received for PCT Patent Application No. PCT/GB2021/051370, mailed on Aug. 30, 2021, 10 pages.

International Search Report and Written Opinion received for PCT Patent Application No. PCT/GB2021/051371, mailed on Sep. 9, 2021, 13 pages.

International Search Report and Written Opinion received for PCT Patent Application No. PCT/GB2021/051372, mailed on Aug. 30, 2021, 10 pages.

International Search Report and Written Opinion received for PCT Patent Application No. PCT/GB2021/051374, mailed on Aug. 31, 2021, 12 pages.

International Search Report and Written Opinion received for PCT Patent Application No. PCT/GB2021/051375, mailed on Sep. 1, 2021, 11 pages.

International Search Report and Written Opinion received for PCT Patent Application No. PCT/GB2021/051376, mailed on Sep. 7, 2021, 11 pages.

International Search Report and Written Opinion received for PCT Patent Application No. PCT/GB2021/051509, mailed on Sep. 17, 2021, 11 pages.

Search Report received for GB Application No. 2010656.3, mailed on Jan. 5, 2021, 1 page.

Search Report received for GB Application No. 2010659.7, mailed on Jan. 5, 2021, 1 page.

Examination Report received for GB Application No. 2305861.3, mailed on Nov. 13, 2023, 1 page.

* cited by examiner

VACUUM CLEANER

CROSS-REFERENCE TO PRIOR APPLICATION

This application is a § 371 National Stage Application of PCT International Application No. PCT/GB2021/051369 filed Jun. 3, 2021, which claims the priority of United Kingdom Application No. 2010655.5, filed Jul. 10, 2020, each of which are herein incorporated by reference in their entirety.

TECHNICAL FIELD

The present disclosure relates to a vacuum cleaner. In particular, but not exclusively, the present disclosure concerns measures, including methods, apparatus and computer programs, for operating a vacuum cleaner.

BACKGROUND

Broadly speaking, there are four types of vacuum cleaner: 'upright' vacuum cleaners, 'cylinder' vacuum cleaners (also referred to as 'canister' vacuum cleaners), 'handheld' vacuum cleaners and 'stick' vacuum cleaners.

Upright vacuum cleaners and cylinder vacuum cleaners tend to be mains-power-operated.

Handheld vacuum cleaners are relatively small, highly portable vacuum cleaners, suited particularly to relatively low duty applications such as spot cleaning floors and upholstery in the home, interior cleaning of cars and boats etc. Unlike upright cleaners and cylinder cleaners, they are designed to be carried in the hand during use, and tend to be powered by battery.

Stick vacuum cleaners may comprise a handheld vacuum cleaner in combination with a rigid, elongate suction wand which effectively reaches down to the floor so that the user may remain standing while cleaning a floor surface. A floor tool is typically attached to the end of the rigid, elongate suction wand, or alternatively may be integrated with the bottom end of the wand.

Stick vacuum cleaners are typically used in environments which contain several different floor surface types, including hard floors and different types of carpet. Greater power from the vacuum motor is usually required to remove dirt from carpets, especially deep pile carpets, compared to hard floors. Some stick vacuum cleaners are capable of sensing whether the surface type is carpet or hard floor and can adjust the power of the vacuum motor accordingly. However, existing devices are based on fixed parameters and are not capable of discovering and adapting to new types of surface. Furthermore, components of the vacuum cleaner can vary as the device ages. This can eventually result in the vacuum cleaner misidentifying the surface type and consequently using a sub-optimal vacuum motor power.

It is an object of the present disclosure to mitigate or obviate the above disadvantages, and/or to provide an improved or alternative vacuum cleaner.

SUMMARY

According to an aspect of the present disclosure, there is provided a vacuum cleaner comprising: a vacuum motor; a first sensor configured to generate first sensor signals based on sensed motion and orientation of the vacuum cleaner; a cleaner head comprising an agitator; one or more diagnostic sensors configured to generate second sensor signals based on sensed parameters of the cleaner head; and a controller configured to: process the generated first and second sensor signals to determine a type of surface on which the vacuum cleaner is being operated; and control the power of the vacuum motor in dependence on the determined type of surface.

The controller combines sensor data generated by different sensors of the vacuum cleaner in order to determine the type of surface. This enables a more accurate determination of the surface type and allows the controller to identify multiple different surface types, e.g. different types of carpet. For example, the first sensor signals may contain different signatures when the vacuum cleaner is operated on different surfaces, due to the different vibrations caused by the different surfaces.

In embodiments, the first sensor comprises an inertial measurement unit, IMU.

In embodiments, the cleaner head further comprises an agitator motor arranged to rotate the agitator and the sensed parameters of the cleaner head comprise the agitator motor current.

In embodiments, the controller is configured to control the power of the agitator motor in dependence on the determined type of surface.

In embodiments, the sensed parameters of the cleaner head comprise the pressure applied to the cleaner head.

In embodiments, the controller is configured to process the generated first and second sensor signals using a surface type model defining a mapping between generated sensor signals and surface types to determine the type of surface on which the vacuum cleaner is being operated.

In embodiments, the surface type model comprises a plurality of clusters, each cluster corresponding to a respective type of surface.

In embodiments, the surface types defined in the surface type model comprise two or more different types of carpet, and hard floor.

In this manner, the vacuum cleaner is not only capable of differentiating between hard floor and carpet, but can distinguish between different types of carpet, thereby enabling further optimization of the cleaning performance and battery runtime.

In embodiments, the surface types defined in the surface type model comprise at least four different types of carpet.

In embodiments, the four different types of carpet comprise: plush carpet, multi-level loop carpet, level loop carpet and deep pile carpet.

According to an aspect of the present disclosure, there is provided a method of operating a vacuum cleaner comprising: generating first sensor signals based on sensed motion and orientation of the vacuum cleaner; generating second sensor signals based on sensed parameters of a cleaner head comprising an agitator; processing the generated first and second sensor signals to determine a type of surface on which the vacuum cleaner is being operated; and controlling the power of the vacuum motor in dependence on the determined type of surface.

According to an aspect of the present disclosure, there is provided a computer program comprising a set of instructions, which, when executed by a computerised device, cause the computerised device to perform a method of operating a vacuum cleaner, the method comprising: generating first sensor signals based on sensed motion and orientation of the vacuum cleaner; generating second sensor signals based on sensed parameters of a cleaner head comprising an agitator; processing the generated first and second sensor signals to determine a type of surface on which the vacuum cleaner is being operated; and controlling the power of the vacuum motor in dependence on the determined type of surface.

The present disclosure is not limited to any particular type of vacuum cleaner. For example, the aspects of the disclosure may be utilised on upright vacuum cleaners, cylinder vacuum cleaners or handheld or 'stick' vacuum cleaners.

It should be appreciated that features described in relation to one aspect of the present disclosure may be incorporated into other aspects of the present disclosure. For example, a method aspect may incorporate any of the features described with reference to an apparatus aspect and vice versa.

DESCRIPTION OF THE DRAWINGS

Embodiments of the present disclosure will now be described by way of example only with reference to the accompanying schematic drawings of which.

DETAILED DESCRIPTION

Figure 1:
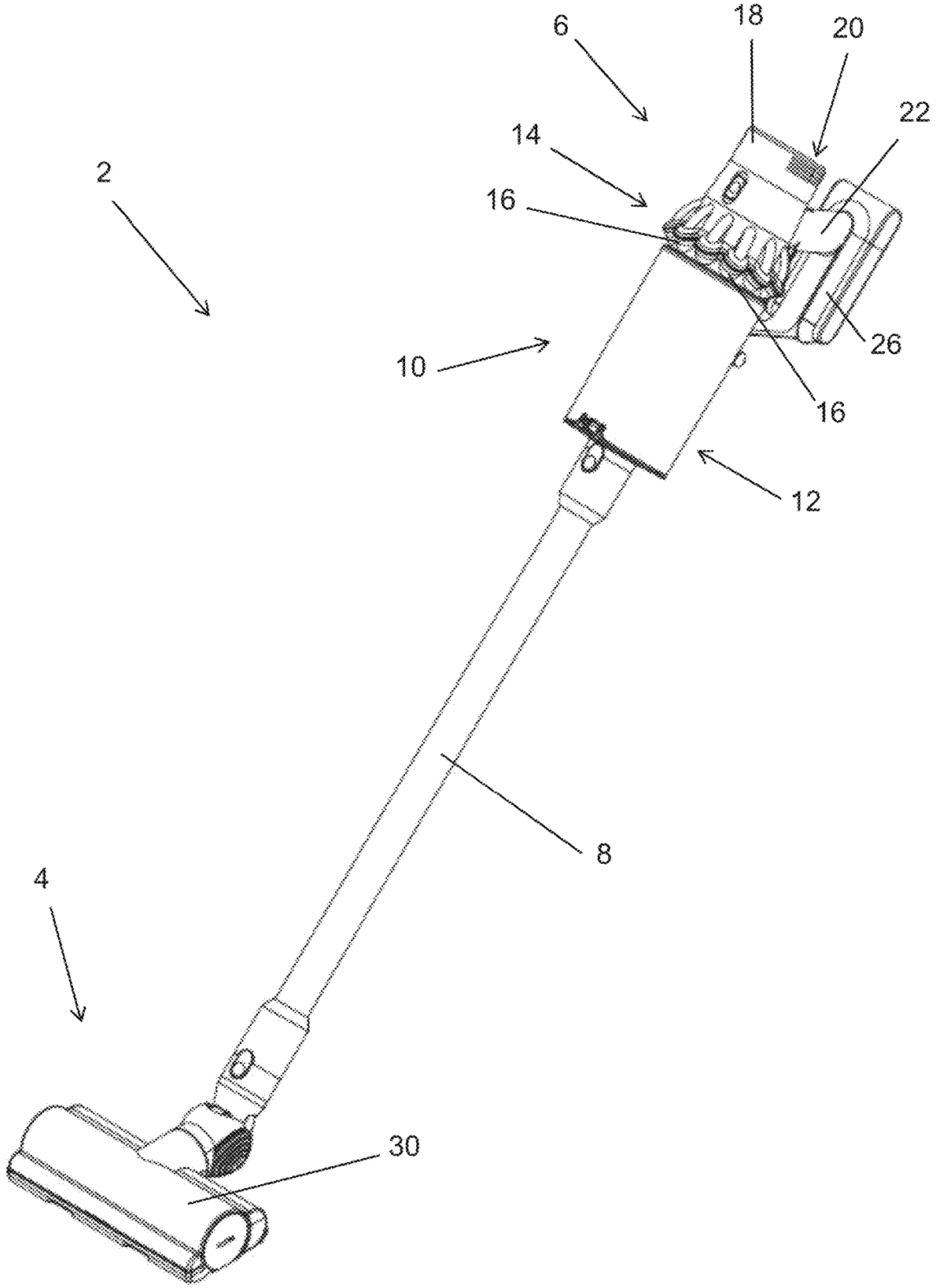
FIG. 1 is a perspective view of a stick vacuum cleaner according to an embodiment of the present disclosure.

FIGS. 1 to 4 illustrate a vacuum cleaner 2 according to embodiments of the present disclosure. The vacuum cleaner 2 is a 'stick' vacuum cleaner comprising a cleaner head 4 connected to a main body 6 by a generally tubular elongate wand 8. The cleaner head 4 is also connectable directly to the main body 6 to transform the vacuum cleaner 2 into a handheld vacuum cleaner. Other removable tools, such as a crevice tool 3, a dusting brush 7 and a miniature motorized cleaner head 5 may be attached directly to the main body 6, or to the end of the elongate wand 8, to suit different cleaning tasks.

The main body 6 comprises a dirt separator 10 which in this case is a cyclonic separator. The cyclonic separator has a first cyclone stage 12 comprising a single cyclone, and a second cyclone stage 14 comprising a plurality of cyclones 16 arranged in parallel. The main body 6 also has a removable filter assembly 18 provided with vents 20 through which air can be exhausted from the vacuum cleaner 2. The main body 6 of the vacuum cleaner 2 has a pistol grip 22 positioned to be held by the user. At an upper end of the pistol grip 22 is a user input device in the form of a trigger switch 24, which is usually depressed in order to switch on the vacuum cleaner 2. However, in some embodiments the physical trigger switch 24 is optional. Positioned beneath a lower end of the pistol grip 22 is a battery pack 26 which comprises a plurality of rechargeable cells 27. A controller 50 and a vacuum motor 52, comprising a fan driven by an electric motor, are provided in the main body 6 behind the dirt separator 10.

Figure 2:
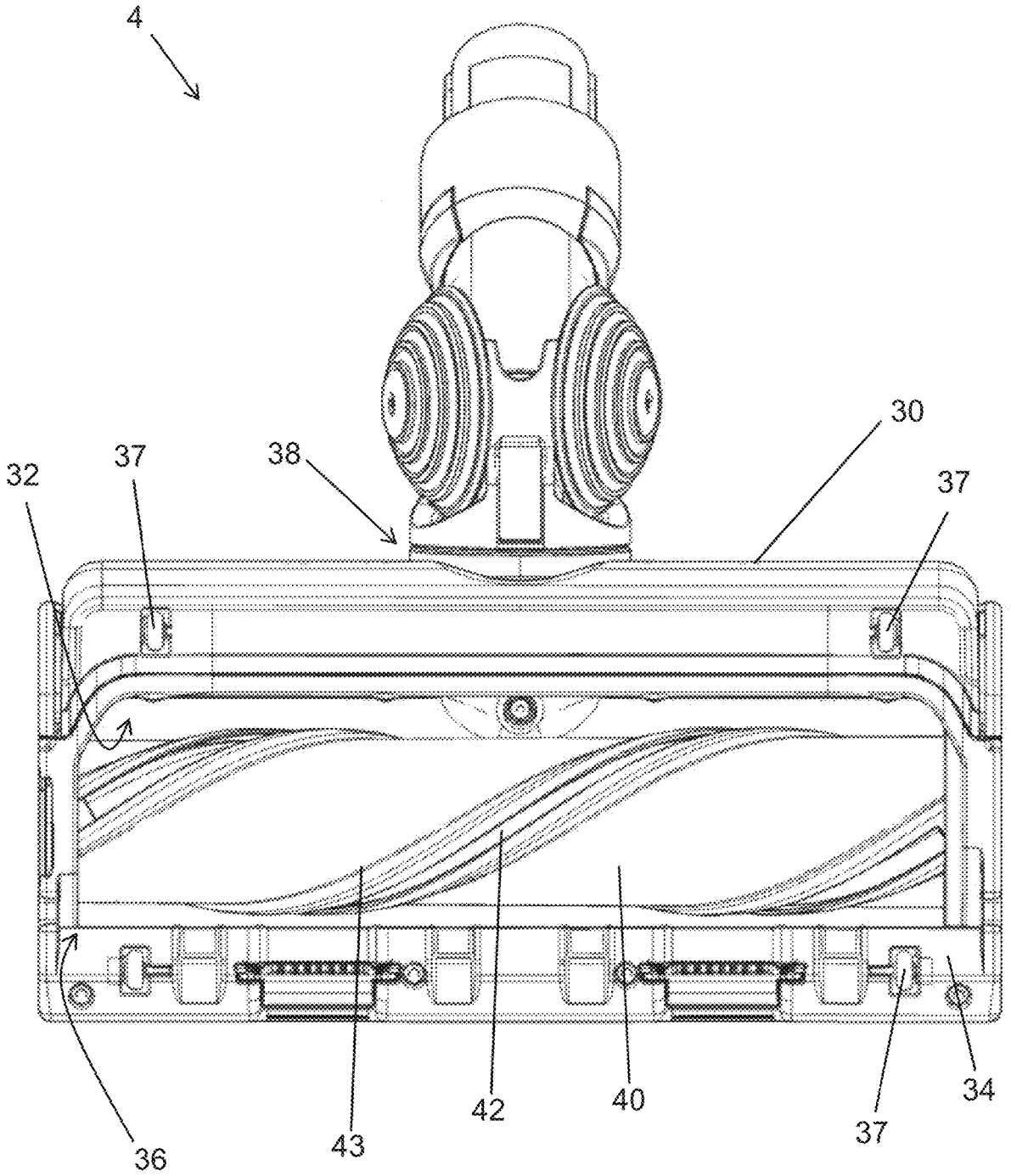
FIG. 2 is a view of a cleaner head of the vacuum cleaner of FIG. 1, shown from underneath.

The cleaner head 4 is shown from underneath in FIG. 2. The cleaner head 4 has a casing 30 which defines a suction chamber 32 and a soleplate 34. The soleplate 34 has a suction opening 36 through which air can enter the suction chamber 32, and wheels 37 for engaging a floor surface. The casing 30 defines an outlet 38 through which air can pass from the suction chamber 32 into the wand 8. Positioned inside the suction chamber 32 is an agitator 40 in the form of a brush bar. The agitator 40 can be driven to rotate inside the suction chamber 32 by an agitator motor 54. The agitator motor 54 of this embodiment is received inside the agitator 40. The agitator 40 has helical arrays of bristles 43 projecting from grooves 42, and is positioned in the suction chamber such that the bristles 43 project out of the suction chamber 34 through the suction opening 36.

Figure 3:
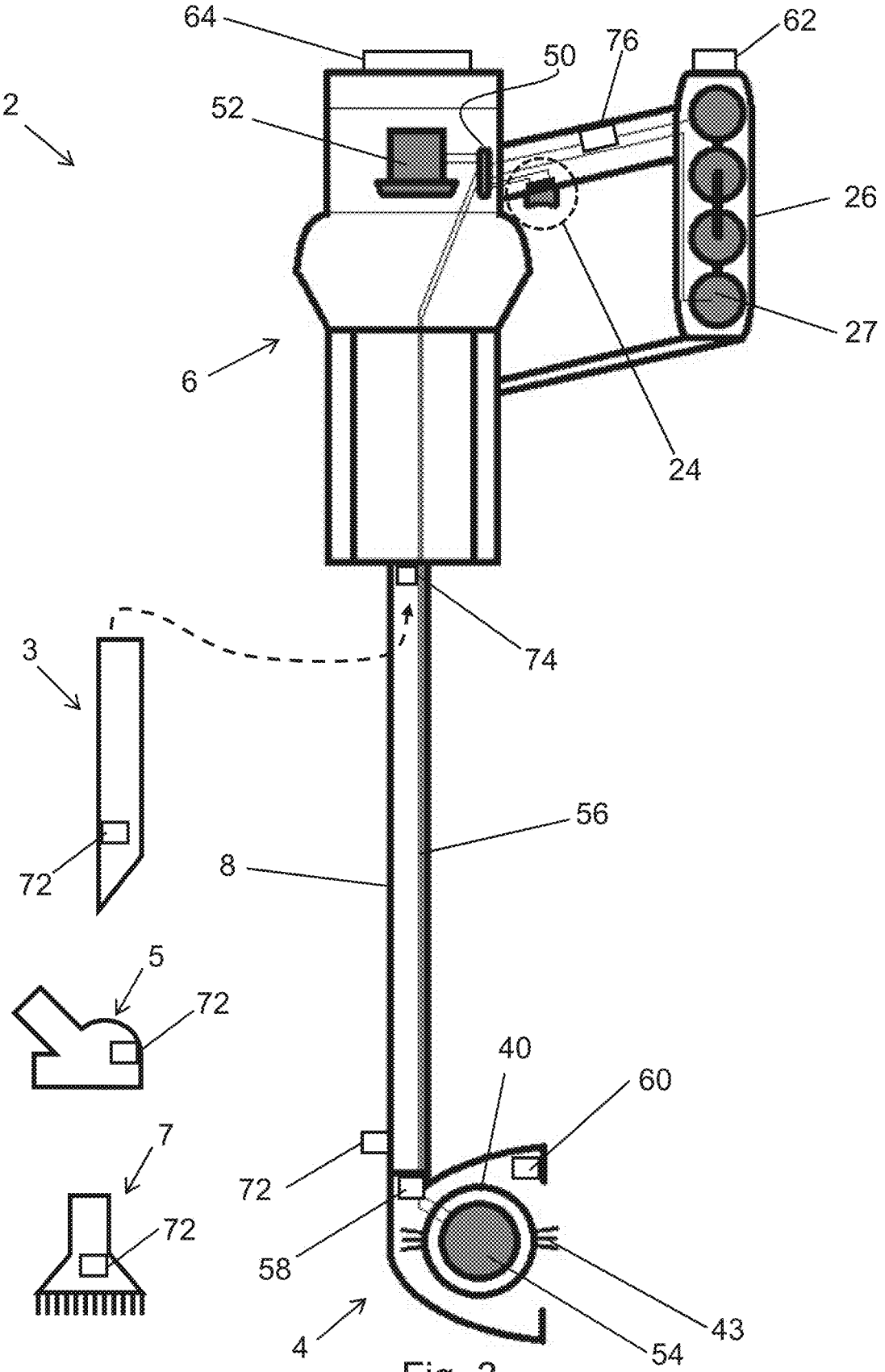
FIG. 3 is a schematic illustration of electrical components of the vacuum cleaner of FIG. 1.

FIG. 3 is a schematic representation of the electrical components of the vacuum cleaner 2. The controller 50 manages the supply of electrical power from the cells 27 of the battery pack 26 to the vacuum motor 52. When the vacuum motor 52 is powered on, this creates a flow of air so as to generate suction. Air with dirt entrained therein is sucked into the cleaner head 4 (or, when attached, one of the other tools such as the crevice tool 3, the mini motorised cleaner head 5, or the dusting brush 7), into the suction chamber 32 through the suction opening 36. From there, the air is sucked through the outlet 38 of the cleaner head 4, along the wand 8 and into the dirt separator 10. Entrained dirt is removed by the dirt separator 10 and then relatively clean air is drawn through the vacuum motor 52, through the filter assembly 18 and out of the vacuum cleaner 2 through the vents 20. In addition, the controller 50 also supplies electrical power from the battery pack 26 to the agitator motor 54 of the cleaner head 4, through wires 56 running along the inside of the wand, so as to rotate the agitator 40. When the cleaner head 4 is on a hard floor, it is supported by the wheels 37 and the soleplate 34 and agitator 40 are spaced apart from the floor surface. When the cleaner head 4 is resting on a carpeted surface, the wheels 37 sink into the pile of the carpet and the soleplate 34 (along with the rest of the cleaner head 4) is therefore positioned further down. This allows carpet fibres to protrude towards (and potentially through) the suction opening 36, whereupon they are disturbed by bristles 43 of the rotating agitator 40 so as to loosen dirt and dust therefrom.

Figure 4:
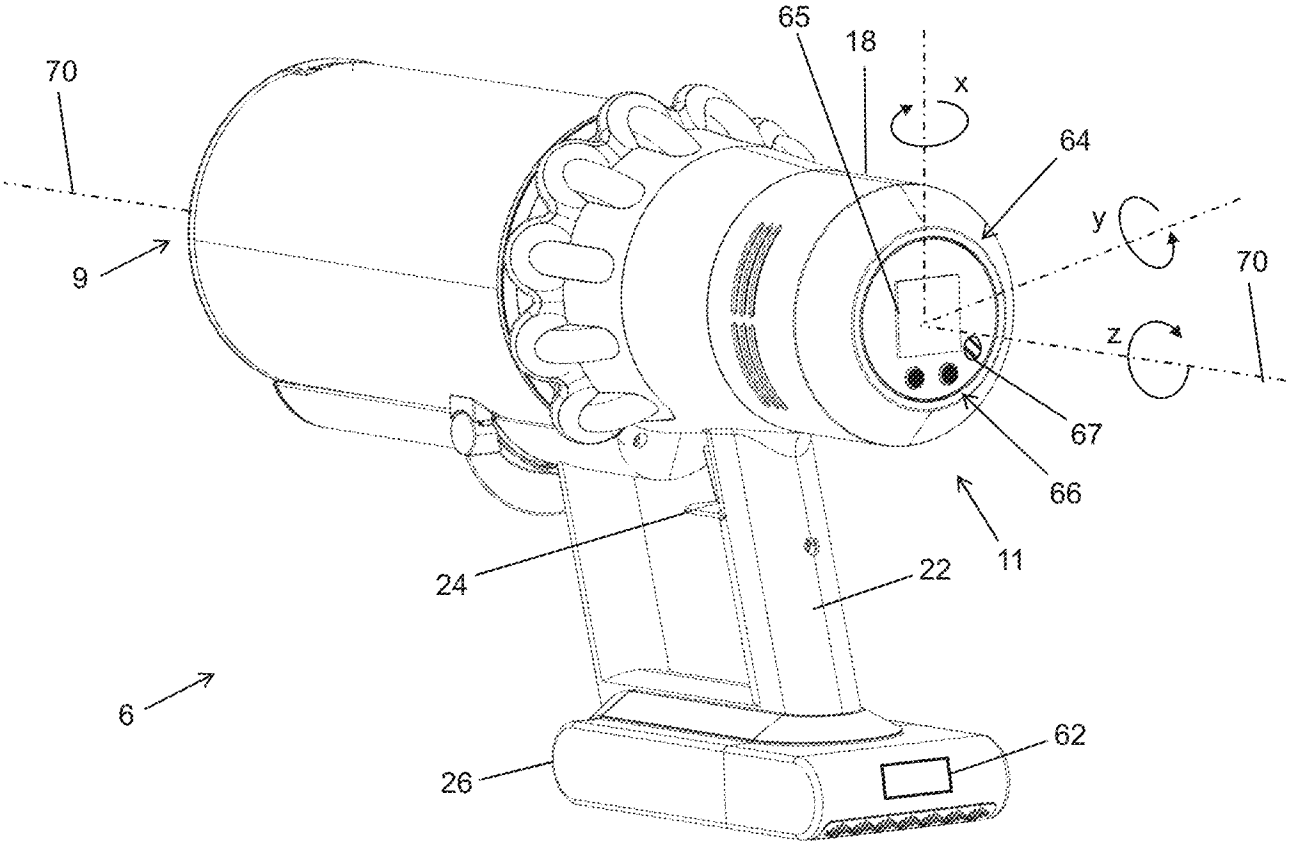
FIG. 4 is a perspective view of a main body of the stick vacuum cleaner of FIG. 1.

Vacuum cleaners 2 according to embodiments of the present disclosure comprise additional components, which are visible in FIGS. 3 and 4. These include one or more of: a current sensor 58 for sensing the electrical current drawn by the agitator motor 54 of the cleaner head 4, a pressure sensor 60 for sensing the pressure applied to the soleplate 34 of the cleaner head 4, an inertial measurement unit (IMU) 62 which is sensitive to motion and orientation of the main body 6 of the vacuum cleaner 2, a human computer interface (HCI) 64, one or more proximity sensors, typically in the form of time of flight (TOF) sensors 72, a tool switch sensor 74 and a capacitive sensor 76 located in the pistol grip 22. Although the current sensor 58 is shown as being situated in the cleaner head 4, it could alternatively be located in the main body 6. For example, the current sensor 58 could be integrated as part of the controller 50, provided it is operable to sense electrical current supplied to the agitator motor 54 from the battery 26 via the wires 56. In the illustrated embodiment, one TOF sensor 72 is located at the end of the detachable wand 8, close to where the cleaner head 4, or one of the other tools 3, 5, 7, is attached. Further TOF sensors 72 may be provided on the removable tools 3, 5, 7 themselves. Each TOF sensor 72 generates a sensor signal dependent on the proximity of objects to the TOF sensor 72. Suitable TOF sensors 72 include radar or laser devices. The tool switch sensor 74 is located on the main body 6 of the vacuum cleaner 2 and generates signals dependent on whether a tool 3, 4, 5, 7 or the wand 8 is attached to the main body 6. In embodiments, the tool switch sensor 74 generates signals dependent on the type of tool 3, 4, 5, 7 attached to main body 6 or the wand 8. The capacitive sensor 76 is located in the pistol grip 22 and generates signals dependent on whether a user is gripping the pistol grip. In embodiments, the vacuum cleaner 2 may comprise one or more additional IMUs. For example, the cleaner head 4 may comprise an IMU which is sensitive to motion and orientation of the cleaner head 4 and which generates further sensor signals to supplement those generated by the IMU 62 of the main body 6. The IMU 62 may comprise one or more accelerometers, one or more gyroscopes and/or one or more magnetometers.

As shown in more detail in FIG. 4, the main body 6 of the vacuum cleaner 2 defines a longitudinal axis 70 which runs from a front end 9 to a rear end 11 of the main body 6. When it is attached to the front end 9 of the main body 6, the wand 8 is parallel to (and in this case collinear with) the longitudinal axis 70. In the illustrated embodiment, the HCI 64 comprises a visual display unit 65, more particularly a planar, full colour, backlit thin-film transistor (TFT) screen. The screen 65 is controlled by the controller 50 and receives power from the battery 26. The screen displays information to the user, such as an error message, an indication of a mode the vacuum cleaner 2 is operating in, or an indication of remaining battery 26 life. The screen 65 faces substantially rearwards (i.e. its plane is orientated substantially normal to the longitudinal axis 70). Positioned beneath the screen 65 (in the vertical direction defined by the pistol grip 22) is a pair of control members 66, also forming part of the HCI 64 and each of which is positioned adjacent to the screen 65 and is configured to receive a control input from the user. In embodiments, the control members are configured to change the mode of the vacuum cleaner, for example to manually increase or decrease the power of the vacuum motor 52. In embodiments, the HCI 64 also comprises an audio output device such as a speaker 67 which can provide audible feedback to the user.

Figure 5A:
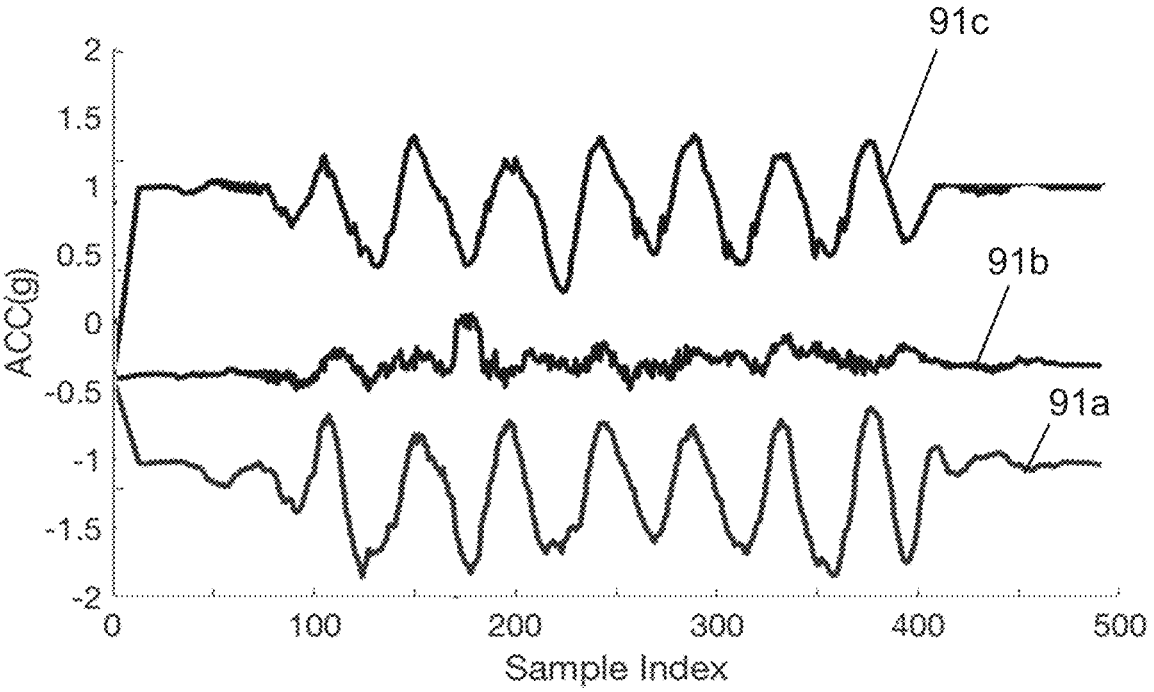
FIGS. 5*a* and 5*b* illustrate sensor signals corresponding to linear and angular acceleration generated by an inertial measurement unit of a vacuum cleaner according to embodiments of the present disclosure.
Figure 5B:
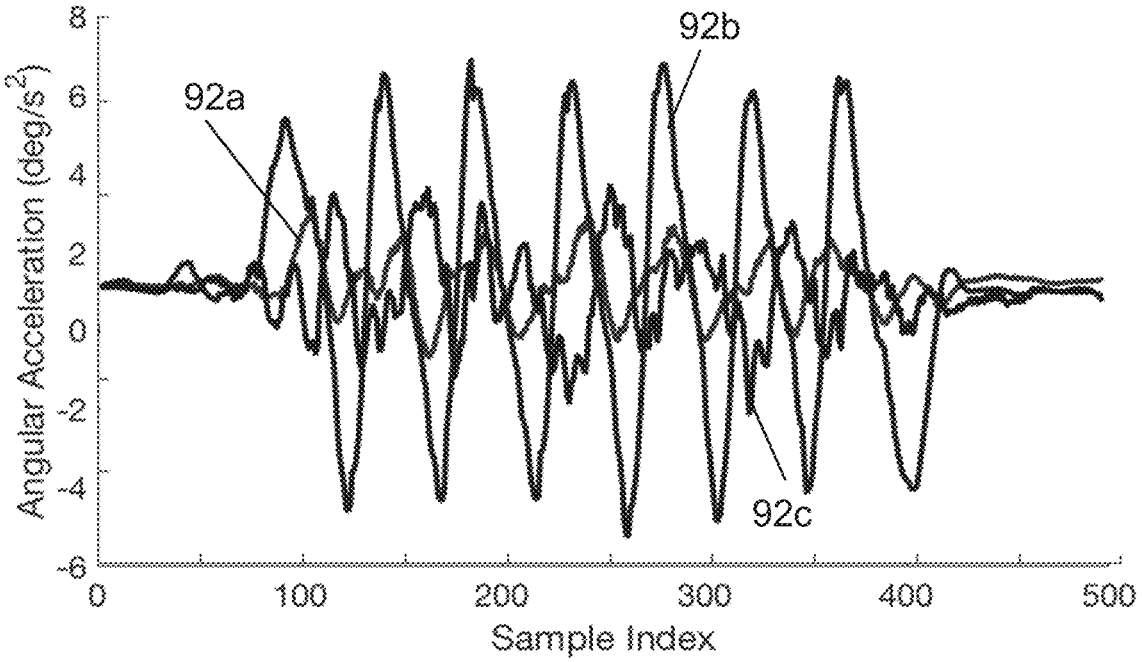
Figure 6:
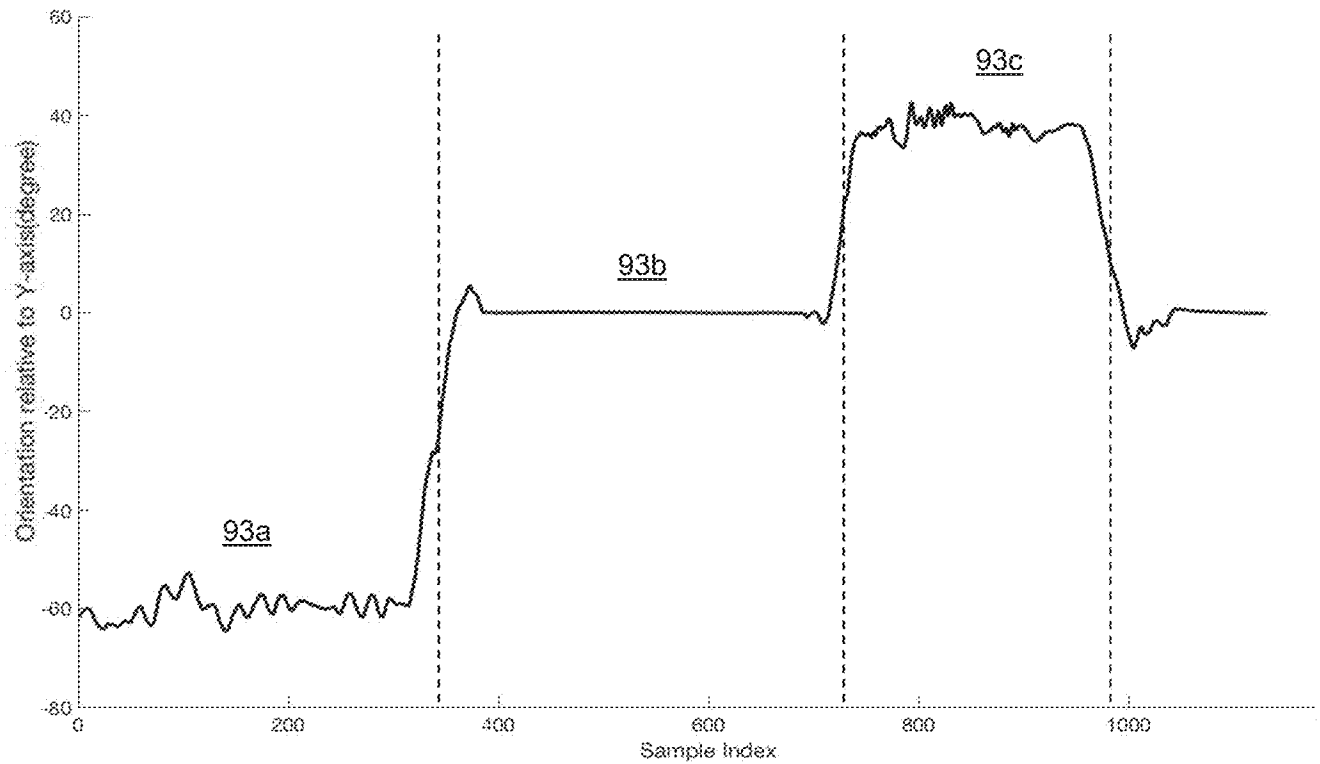
FIGS. 6 and 7 illustrates further sensor signals corresponding to orientation generated by the inertial measurement unit of a vacuum cleaner according to embodiments of the present disclosure.
Figure 7:
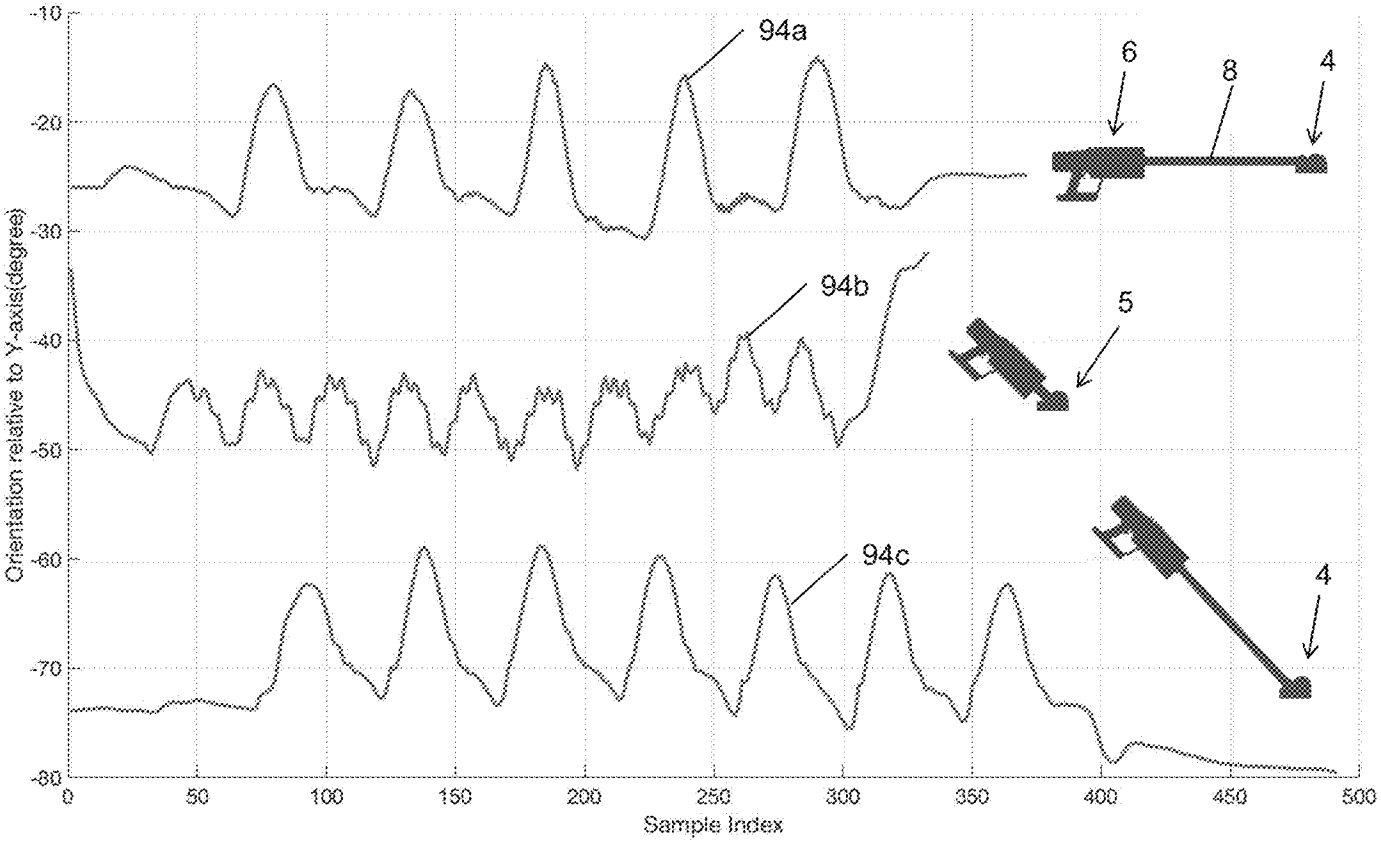

The IMU 62 generates sensor signals dependent on the motion and orientation of the main body 6 of the vacuum cleaner 2 in three spatial dimensions (x, y, and z). The motion includes the linear acceleration and angular acceleration of the main body 6. FIG. 5*a* illustrates exemplary generated IMU 62 sensor data corresponding to the linear acceleration of the main body 6 before, during and after a cleaning operation. The time scale shows the index of samples which were gathered at a sampling rate of 25 Hz. The vertical scale is in units of acceleration due to gravity. Traces 91*a*, 91*b* and 91*c* correspond to the linear acceleration of the main body 6 in the x, y and z directions respectively. FIG. 5*b* illustrates exemplary generated IMU 62 sensor data corresponding to the angular acceleration of the main body 6 before, during and after the same cleaning operation as represented in FIG. 5*a*. Traces 92*a*, 92*b* and 92*c* correspond to the angular acceleration about the x, y and z axes respectively. In both FIGS. 5*a* and 5*b*, the vacuum cleaner 2 is initially static (at rest). This is followed by a cleaning session comprising cleaning strokes, giving rise to oscillatory behaviour in some of the generated sensor data. Finally, the vacuum cleaner 2 is again returned to rest. The data shown in FIGS. 5*a* and 5*b* have been smoothed, for example by means of a band-pass filter or a low-pass filter. FIG. 6 illustrates example generated IMU 62 sensor data corresponding to of the orientation of the main body 6 about the y axis during different hand-held cleaning operations. Specifically, interval 93*a* corresponds to cleaning of a low-level surface, e.g. a skirting board, interval 93*b* corresponds to a period during which the main body 6 is at rest on a table and interval 93*c* corresponds to cleaning of an elevated surface, for example a ceiling, blind, curtain, or the top of a cupboard. FIG. 7 illustrates further exemplary generated IMU 62 sensor data corresponding to orientation of the main body 6 about the y axis during different cleaning operations using the motorized cleaner heads 4, 5. Trace 94*a* corresponds to cleaning under furniture using the main cleaner head 4 attached to the wand 8. Trace 94*b* corresponds to stair cleaning using the miniature motorized cleaner head 5 attached directly to the main body 6, without using the wand 8. Trace 94*c* corresponds to normal upright vacuum cleaning using the cleaner head 4 attached to the wand 8. It should be appreciated that the different cleaning activities give rise to different signatures in the sensor data generated by the IMU 62. In this manner, it should be appreciated that the IMU 62 sensor data can be processed to infer information about the cleaning activity being performed by a user using the vacuum cleaner, or about the environment in which the vacuum cleaner is being operated.

Figure 8:
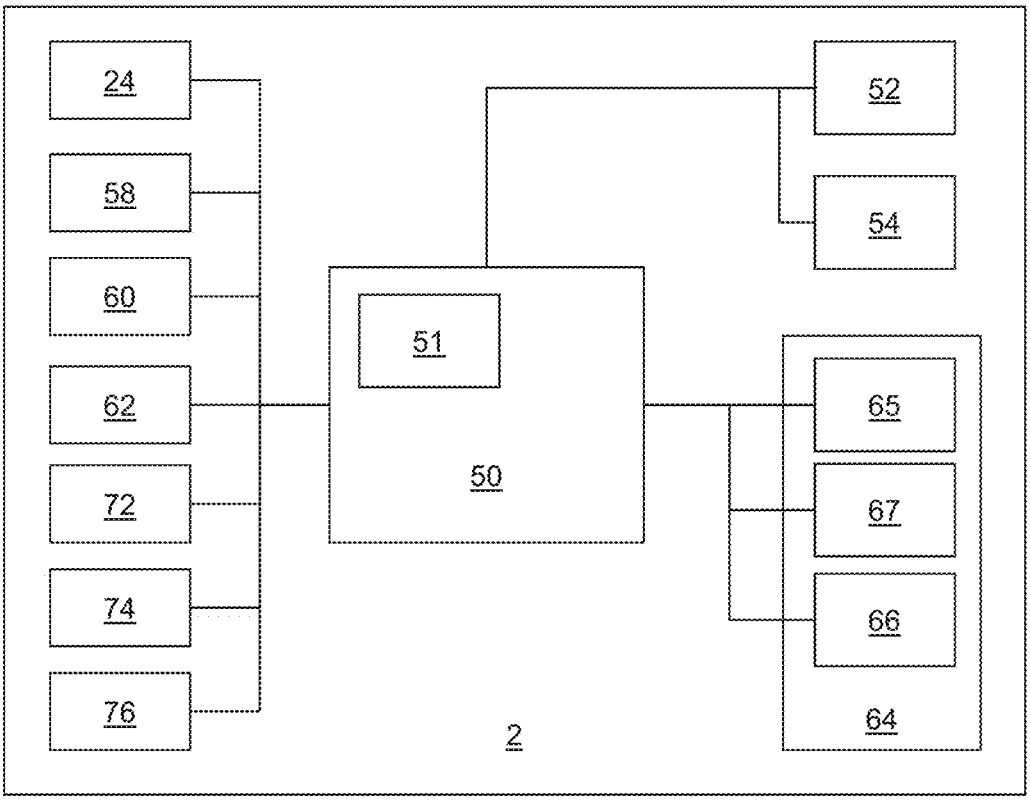
FIG. 8 is a simplified schematic illustration of electrical components of the vacuum cleaner of FIG. 3, showing electrical connections between sensors, a human-computer interface, motors and the controller according to embodiments of the present disclosure.

FIG. 8 illustrates schematically the electrical layout of the vacuum cleaner 2 according to embodiments. In embodiments, the controller 50 receives and processes signals generated by one or more of the trigger 24, the current sensor 58, the pressure sensor 60, the IMU 62, the one or more TOF sensors 72, the tool switch sensor 74 and the capacitive sensor 76. The controller 50 has a memory 51 on which are stored instructions according to which the controller 50 processes the sensor signals. Based on the processing of the sensor signals, the controller 50 controls one or more of the vacuum motor 52, the agitator motor 54 and the HCI 64 in order to enhance operation of the vacuum cleaner 2 and thereby improve the user experience. Example enhancements include improved pickup of dirt and improved battery life, amongst others.

Figure 9:
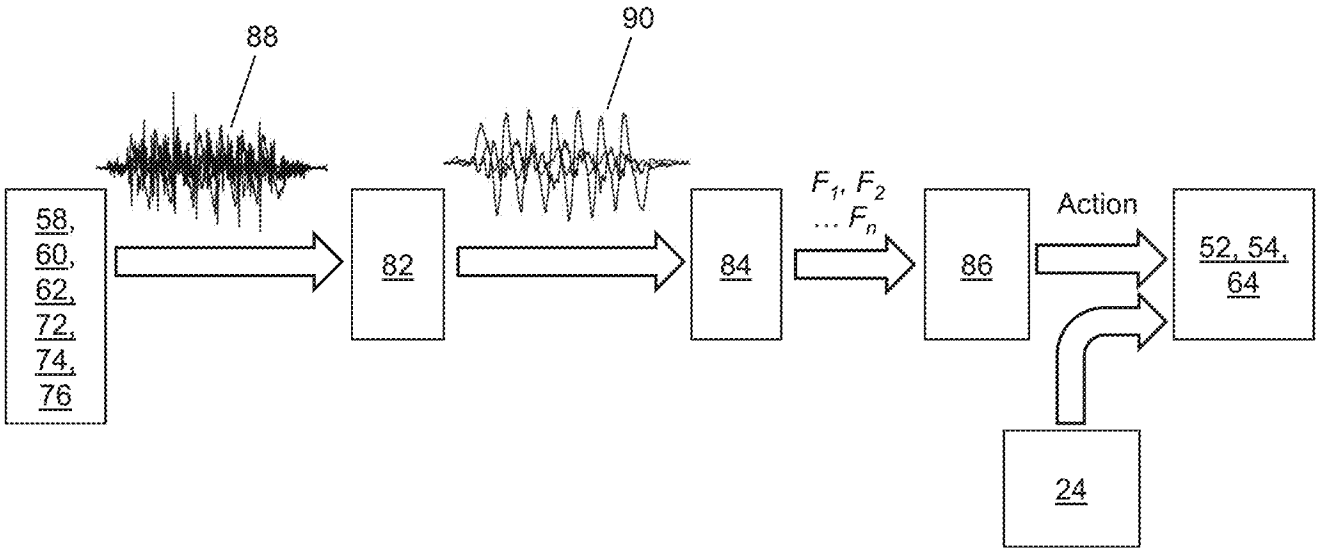
FIG. 9 is a block diagram illustrating example sensor signal processing performed by the controller according to various embodiments of the present disclosure.

FIG. 9 is a block diagram which illustrates example sensor signal processing performed by the controller 50 according to various embodiments of the present disclosure. Unfiltered sensor signals 88 are received at the controller 50 from one or more of the available sensors. Different embodiments utilize sensor signals from different sensors. Some embodiments utilize sensor signals from only one sensor, such as the IMU 62, for example. A band-pass filter or low-pass filter 82 filters the raw sensor signals 88 to generate smoothed sensor signals 90 which are more suitable for further processing. At block 84, pre-determined features $F_1$, $F_2 \ldots F_n$ are extracted from the smoothed sensor signals and subsequently analysed by a classifier 86. In embodiments, the classifier 86 determines, from the extracted features, a particular cleaning activity being performed by a user using the vacuum cleaner 2. In other embodiments, the classifier 86 determines, from the extracted features a particular surface type on which the vacuum cleaner 2 is being operated. In other embodiments, the classifier 86 determines, from the extracted features, whether the vacuum cleaner 2 is actively being used, to assist in providing a trigger-less vacuum cleaner 2. Having determined the above, the controller 50 causes an action or actions to be performed involving one or more of the vacuum motor 52, agitator motor 54 and HCI 64, which are configured in dependence on the classifier 86 output, and optionally on the status of the trigger 24. It should be appreciated that the filter 82, feature extraction block 84 and classifier 86 are in general implemented as software modules which are executed on or under the control of the controller 50. The controller memory 51 stores sets of instructions defining the operation of the filter 82, feature extraction 84, classifier 86 and resultant action. In embodiments, the classifier is based on a machine learning classifier such as an artificial neural network, a random forest, a support-vector machine or any other appropriate trained model. The model could have been pre-trained, for example at the factory, using a supervised learning approach. A sliding window approach is generally used to span the filtered sensor signals and extract features corresponding to that particular time portion of the signal. Consecutive frames usually overlap to some degree but are usually processed separately. It should be appreciated that it is not always necessary to receive and process sensor data from all of the available sensors. For example, in embodiments the controller 50 may process only IMU 62 sensor data to obtain a classifier output. Furthermore, in the case of IMU 62 sensor data, the controller 50 may for example take account only of IMU 62 sensor data relating to orientation of the vacuum cleaner 2, or only IMU 62 sensor data relating to acceleration of the vacuum cleaner 2.

Vacuum cleaners 2 are typically used in environments which contain several different floor surface types, including hard floors and different types of carpet. Greater power from the vacuum motor 52 is usually required to remove dirt from carpets, especially deep pile carpets, compared to hard floors. However, this often comes at the expense of reduced runtime for battery 26 powered vacuum cleaners 2. In general, the power delivered to the vacuum motor 52 should be increased when the cleaner head 4 is on a carpet and should be reduced when the cleaner head 4 is on a hard floor. In this manner, the runtime can be preserved without appreciable loss in cleaning performance.

Figure 10:
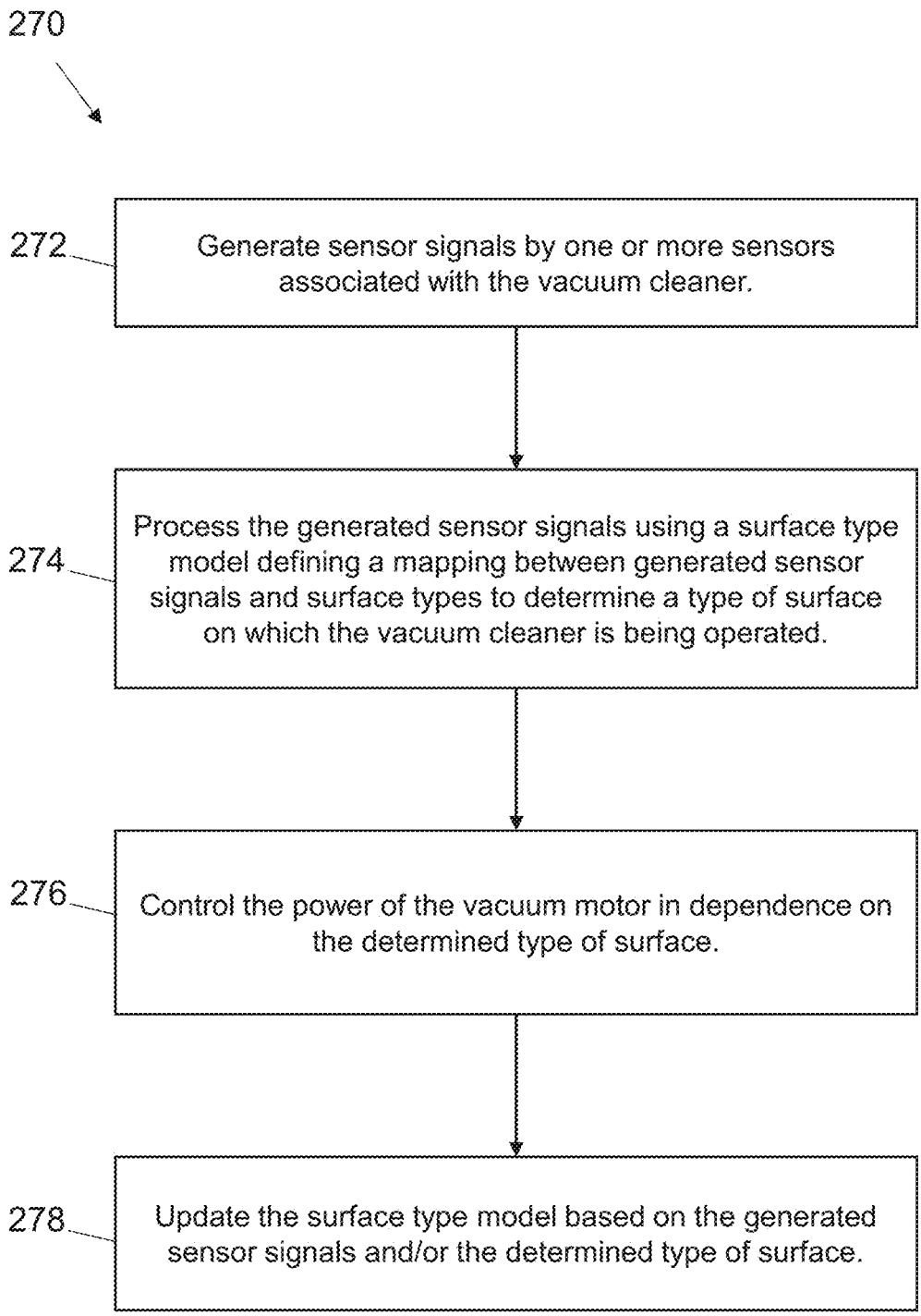
FIG. 10 is a flow diagram showing a method of operating a vacuum cleaner in which a surface type is detected according to embodiments of the present disclosure.

FIG. 10 is a flow diagram showing a method 270 of operating a vacuum cleaner 2 according to embodiments. In step 272, sensor signals are generated by one or more sensors associated with the vacuum cleaner 2. In embodiments, one of the sensors is a sensor configured to generate sensor signals based on sensed motion and orientation of the vacuum cleaner 2, such as the IMU 62. Where the vacuum cleaner is used in conjunction with a cleaner head 4 comprising an agitator 40 driven by an agitator motor 54, the sensors may include diagnostic sensors configured to generate sensor signals based on sensed parameters of the cleaner head 4. Such diagnostic sensors include the current sensor 58 which senses the current drawn by the agitator motor 54 and the pressure sensor 60 which senses the pressure applied to the cleaner head 4. However, it should be appreciated that in some embodiments only sensor signals from the IMU 62 are used, or only sensor signals from the diagnostic sensors are used. In step 274, the generated sensor signals are processed by the controller 50 using a surface type model defining a mapping between generated sensor signals and surface types to determine a type of surface on which the vacuum cleaner 2 is being operated. In step 276, the power of the vacuum motor 52 is controlled in dependence on the determined type of surface. In step 278, the surface type model is updated based on the generated sensor signals and/or the determined type of surface. In embodiments, the surface type model accounts for different types of carpet, such as plush carpet, multi-level loop carpet, level loop carpet and deep pile carpet. Accordingly, the vacuum cleaner 2 can not only distinguish between hard floor and carpet, but can even distinguish between different types of carpet, enabling further control of the vacuum motor 52 power to optimize cleaning efficiency and runtime.

Figure 11:
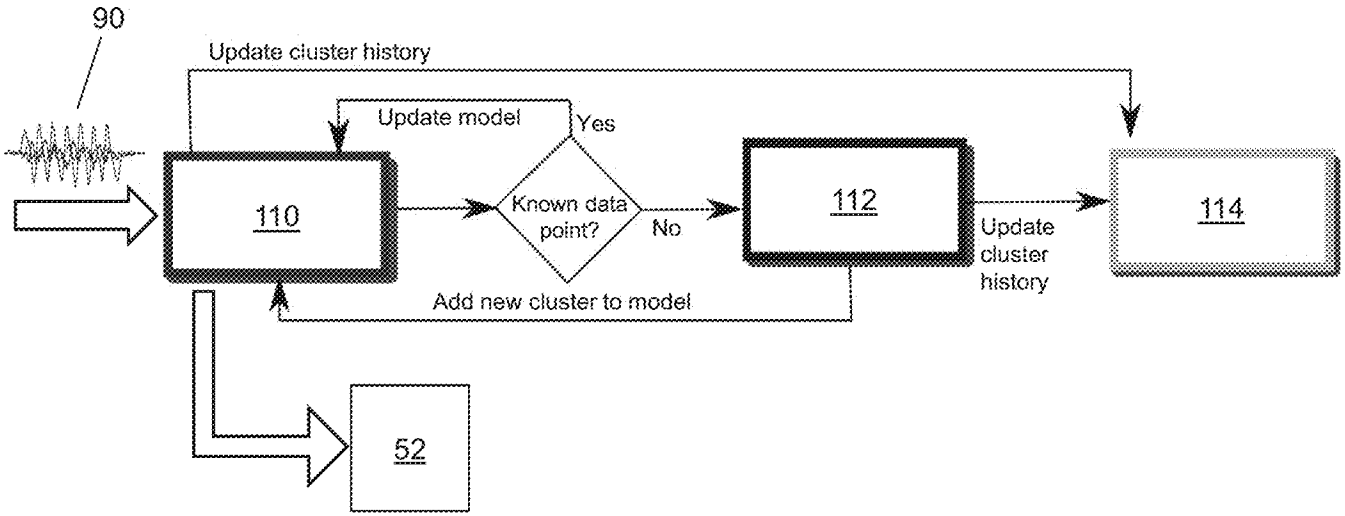
FIG. 11 is a block diagram illustrating example sensor signal processing performed by the controller applicable to the method illustrated in FIGS. 10 and 13 according to embodiments of the present disclosure.
Figure 12A:
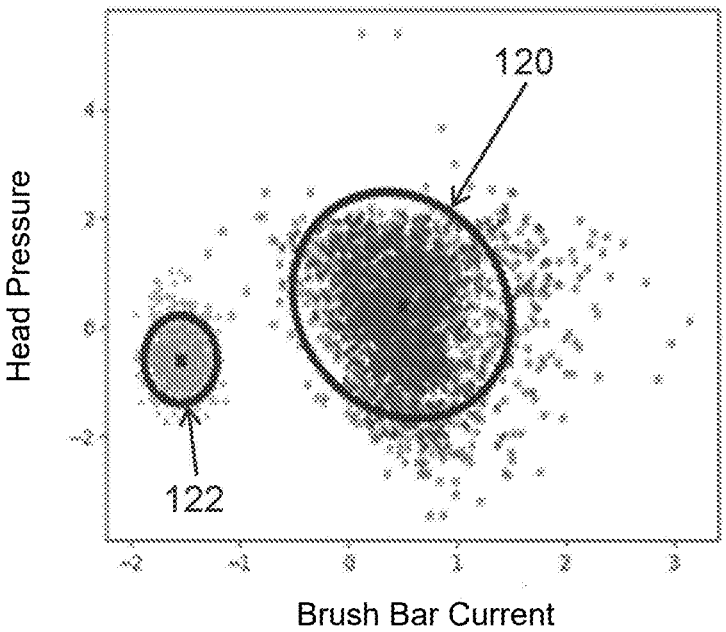
FIGS. 12*a* and 12*b* illustrate example surface type models defining a mapping between generated sensor signals and surface types according to embodiments of the present disclosure.
Figure 12B:
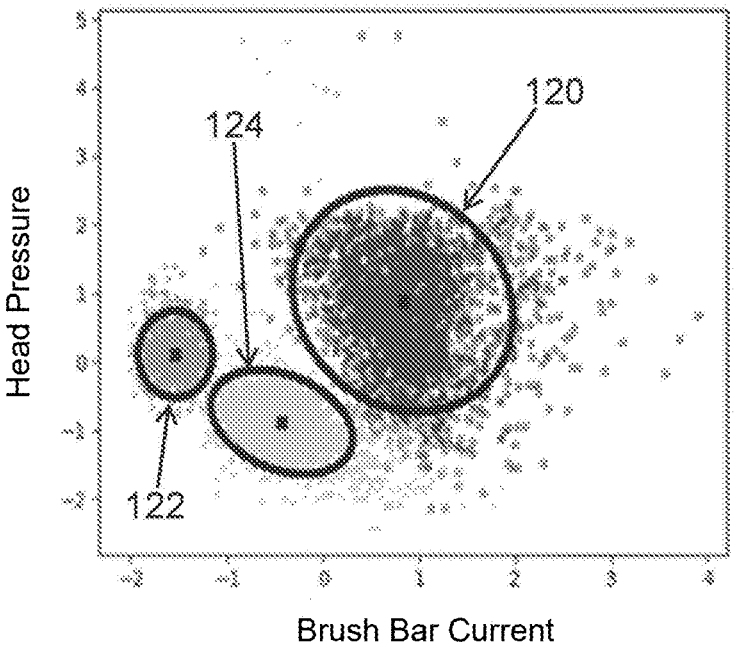

With reference to FIG. 11, the filtered sensor signals 90 from the one or more sensors associated with the vacuum cleaner 2 form an input to the surface type model 110. It should be appreciated that in embodiments, the surface type model 110 is akin to the feature extraction block 84 and classifier 86 described with reference to FIG. 9. The surface type model 110 provides an output corresponding to the determined surface type, on the basis of which the power of the vacuum motor 52 is controlled, as shown in FIG. 11. With reference to FIG. 12*a*, the surface type 110 model may comprise a plurality of clusters 120, 122 within a parameter space, each of which corresponds to a respective type of surface. In FIG. 12*a*, the parameter space is formed by the cleaner head pressure, sensed by the pressure sensor 60, and the agitator motor current (or brush bar current), sensed by the current sensor 58. In FIGS. 12*a* and 12*b* the agitator motor current and head pressure have been re-scaled to form dimensionless quantities which are more convenient for representation in a parameter space. Each point in the parameter space corresponds to an extracted value pair for the two sensors. It should be appreciated that greater or fewer than two sensor types may be used, such that in general the parameter space is n-dimensional. The clusters 120, 122 can be determined using a Gaussian fitting procedure which would be understood by one skilled in the art. Determining the type of surface on which the vacuum cleaner 2 is being operated generally involves determining which cluster 120, 122 an extracted value pair (current and pressure in this example) belongs to.

Aside from controlling the vacuum motor 52 in dependence on the determined surface type, in embodiments additional steps are performed in order to improve and adapt the surface type model 110 dynamically over time. With reference to FIG. 11, the controller 50 determines whether a data point (i.e. an extracted sensor value or values, such as a particular current and pressure pair) corresponds to an existing cluster 120, 122. If it does correspond to an existing cluster, updating the surface type model 110 comprises reinforcing or adjusting an existing cluster 120, 122 of the surface type model 110. For example, the controller 50 may periodically recalculate the Gaussian fit to account for slight variations in parameters of the vacuum cleaner over time, which may result in a shifting of the Gaussian width or centre. Alternatively, if data points do not correspond to an existing cluster 120, 122, the controller 50 can discover a novel cluster, at 112. With reference to FIG. 12*b*, a novel cluster 124 has been discovered from a series of data points collected over time. The novel cluster 124 may correspond to a new surface type which was not contained in the initial surface type model 110. The novel cluster 124 is optionally added to the surface type model 110 such that the vacuum cleaner 2 can respond to the new surface type in future vacuum cleaning operations. This may be assisted by the user manually entering a desired vacuum motor power 52 for the novel surface, which the controller 50 will then subsequently remember when it detects the surface again in the future. The controller 50 retains a cluster history 114 in memory 51 which allows the controller 50 to track variations in parameters of the vacuum cleaner 2 over time, e.g. due to wear and tear on bristles of the cleaner head 4. In embodiments, the controller is configured to purge (i.e. remove/delete) a particular cluster from the memory 51 in response to determining that the type of surface corresponding to that particular cluster has not been observed for a pre-determined period of time. In this manner, if a surface is not observed for a period of time then the cluster will be aged-out from the memory of the vacuum cleaner, reducing on-device storage requirements. The pre-determined period of time could be one week, one month or one year, for example.

Figure 13:
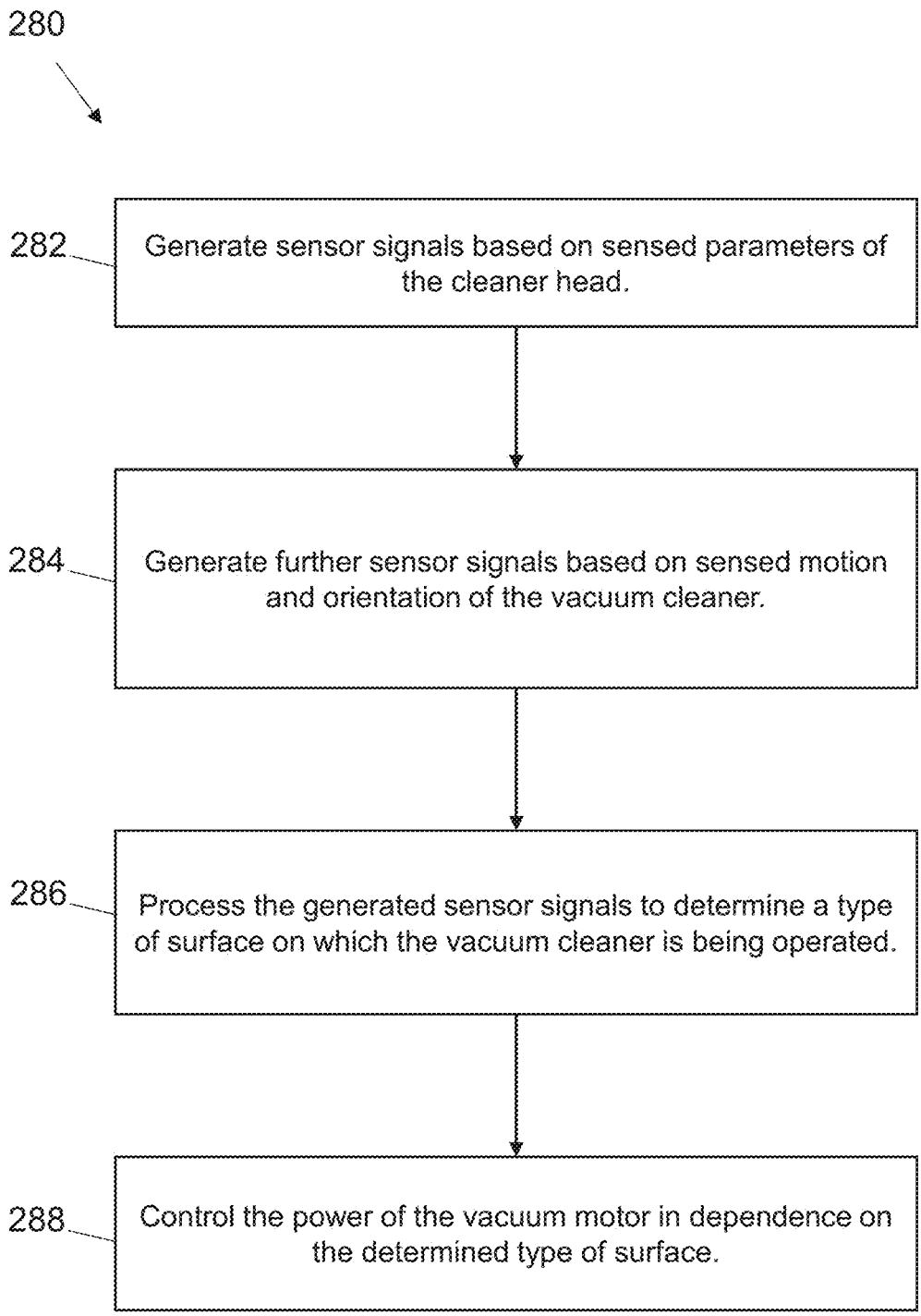
FIG. 13 is a flow diagram showing a method of operating a vacuum cleaner in which a surface type is detected according to embodiments of the present disclosure.

FIG. 13 is a flow diagram showing a method 280 of operating a vacuum cleaner 2 according to embodiments. In step 282, sensor signals are generated based on sensed parameters of the cleaner head 4. In embodiments where the cleaner head 4 comprises an agitator 40 driven by an agitator motor 54, diagnostic sensors are configured to generate the sensor signals based on sensed parameters of the cleaner head 4. Such diagnostic sensors include the current sensor 58 which senses the current drawn by the agitator motor 54 and the pressure sensor 60 which senses the pressure applied to the cleaner head 4. In step 284, further sensor signals are generated based on sensed motion and orientation of the vacuum cleaner. In embodiments, the further sensor signals are generated by the IMU 62. In step 286, the generated sensor signals (based on sensed parameters of the cleaner head and based on sensed motion and orientation of the vacuum cleaner) are processed by the controller 50 to determine a type of surface on which the vacuum cleaner 2 is being operated. In step 288, the power of the vacuum motor 52 is controlled in dependence on the determined type of surface. Accordingly, the controller 50 combines sensed motion and orientation with sensed parameters of the cleaner head 4 in order to determine the surface type. This may be achieved using a surface type model 110 defining a mapping between generated sensor signals and surface types, such as that described with reference to FIGS. 11, 12*a* and 12*b*. The surface type model may contain a plurality of clusters 120, 122, each of which corresponds to a respective type of surface. The model may be static, such that updating of the surface type model is optional.

It is to be understood that any feature described in relation to any one embodiment and/or aspect may be used alone, or in combination with other features described, and may also be used in combination with one or more features of any other of the embodiments and/or aspects, or any combination of any other of the embodiments and/or aspects. For example, it will be appreciated that features and/or steps described in relation to a given one of the methods 270, 280 may be included instead of or in addition to features and/or steps described in relation to other ones of the methods 270, 280.

In embodiments of the present disclosure, the vacuum cleaner 2 comprises a controller 50. The controller 50 is configured to perform various methods described herein. In embodiments, the controller comprises a processing system. Such a processing system may comprise one or more processors and/or memory. Each device, component, or function as described in relation to any of the examples described herein, for example the IMU 62 and/or HCI 64 may similarly comprise a processor or may be comprised in apparatus comprising a processor. One or more aspects of the embodiments described herein comprise processes performed by apparatus. In some examples, the apparatus comprises one or more processors configured to carry out these processes. In this regard, embodiments may be implemented at least in part by computer software stored in (non-transitory) memory and executable by the processor, or by hardware, or by a combination of tangibly stored software and hardware (and tangibly stored firmware). Embodiments also extend to computer programs, particularly computer programs on or in a carrier, adapted for putting the above described embodiments into practice. The program may be in the form of non-transitory source code, object code, or in any other non-transitory form suitable for use in the implementation of processes according to embodiments. The carrier may be any entity or device capable of carrying the program, such as a RAM, a ROM, or an optical memory device, etc.

The one or more processors of processing systems may comprise a central processing unit (CPU). The one or more processors may comprise a graphics processing unit (GPU). The one or more processors may comprise one or more of a field programmable gate array (FPGA), a programmable logic device (PLD), or a complex programmable logic device (CPLD). The one or more processors may comprise an application specific integrated circuit (ASIC). It will be appreciated by the skilled person that many other types of device, in addition to the examples provided, may be used to provide the one or more processors. The one or more processors may comprise multiple co-located processors or multiple disparately located processors. Operations performed by the one or more processors may be carried out by one or more of hardware, firmware, and software. It will be appreciated that processing systems may comprise more, fewer and/or different components from those described.

The techniques described herein may be implemented in software or hardware, or may be implemented using a combination of software and hardware. They may include configuring an apparatus to carry out and/or support any or all of techniques described herein. Although at least some aspects of the examples described herein with reference to the drawings comprise computer processes performed in processing systems or processors, examples described herein also extend to computer programs, for example computer programs on or in a carrier, adapted for putting the examples into practice. The carrier may be any entity or device capable of carrying the program. The carrier may comprise a computer readable storage media. Examples of tangible computer-readable storage media include, but are not limited to, an optical medium (e.g., CD-ROM, DVD-ROM or Blu-ray), flash memory card, floppy or hard disk or any other medium capable of storing computer-readable instructions such as firmware or microcode in at least one ROM or RAM or Programmable ROM (PROM) chips.

Where in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the present disclosure that are described as preferable, advantageous, convenient or the like are optional and do not limit the scope of the independent claims. Moreover, it is to be understood that such optional integers or features, whilst of possible benefit in some embodiments of the present disclosure, may not be desirable, and may therefore be absent, in other embodiments.

The invention claimed is:

1. A vacuum cleaner comprising:

a main body;

a vacuum motor;

a first sensor configured to generate first sensor signals based on sensed motion and orientation of the main body;

a cleaner head comprising an agitator and an agitator motor arranged to rotate the agitator;

one or more diagnostic sensors configured to generate second sensor signals based on sensed parameters of the cleaner head, the sensed parameters comprising an agitator motor current; and a controller configured to:

process the generated first and second sensor signals to determine a type of surface on which the vacuum cleaner is being operated; and control the power of the vacuum motor in dependence on the determined type of surface.

2. The vacuum cleaner of claim 1, wherein the first sensor comprises an inertial measurement unit (IMU).

3. The vacuum cleaner of claim 1, wherein the controller is configured to control the power of the agitator motor in dependence on the determined type of surface.

4. The vacuum cleaner of claim 1, wherein the sensed parameters of the cleaner head comprise the pressure applied to the cleaner head.

5. The vacuum cleaner of claim 1, wherein the controller is configured to process the generated first and second sensor signals using a surface type model defining a mapping between generated sensor signals and surface types to determine the type of surface on which the vacuum cleaner is being operated.

6. The vacuum cleaner of claim 5, wherein the surface type model comprises a plurality of clusters, each cluster corresponding to a respective type of surface.

7. The vacuum cleaner of claim 5, wherein the surface types defined in the surface type model comprise two or more different types of carpet, and hard floor.

8. The vacuum cleaner of claim 7, wherein the surface types defined in the surface type model comprise at least four different types of carpet.

9. The vacuum cleaner of claim 8, wherein the four different types of carpet comprise: plush carpet; multi-level loop carpet; level loop carpet; and deep pile carpet.

10. A vacuum cleaner comprising:

a main body;

a vacuum motor;

a first sensor configured to generate first sensor signals based on sensed motion and orientation of the main body;

a cleaner head comprising an agitator;

one or more diagnostic sensors configured to generate second sensor signals based on sensed parameters of the cleaner head, the sensed parameters comprising a pressure applied to the cleaner head; and a controller configured to:

process the generated first and second sensor signals to determine a type of surface on which the vacuum cleaner is being operated; and control the power of the vacuum motor in dependence on the determined type of surface.

11. A vacuum cleaner comprising:

a main body;

a vacuum motor;

a first sensor configured to generate first sensor signals based on sensed motion and orientation of the main body;

a cleaner head comprising an agitator;

one or more diagnostic sensors configured to generate second sensor signals based on sensed parameters of the cleaner head; and a controller configured to:

process the generated first and second sensor signals to determine a type of surface on which the vacuum cleaner is being operated; and control the power of the vacuum motor in dependence on the determined type of surface, wherein the controller is configured to process the generated first and second sensor signals using a surface type model defining a mapping between sensor signals and surface types to determine the type of surface on which the vacuum cleaner is being operated, and the surface types defined in the surface type model comprise two or more different types of carpet and hard floor.

* * * * *